US006315240B1

(12) United States Patent
Rasmussen et al.

(10) Patent No.: US 6,315,240 B1
(45) Date of Patent: Nov. 13, 2001

(54) TACTICAL MISSILE CONTROL SURFACE ATTACHMENT

(75) Inventors: Perry Rasmussen, Tucson, AZ (US); Eric Brogmus, South Lyon, MI (US); Scott Stubbs, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/516,846

(22) Filed: Mar. 2, 2000

(51) Int. Cl.[7] ..... F42B 10/04; F42B 10/06
(52) U.S. Cl. ..... 244/3.24; 244/3.24; 244/3.29
(58) Field of Search ..... 244/3.24, 3.29

(56) References Cited

U.S. PATENT DOCUMENTS 3,093,075 * 6/1963 Garrett et al. ..... 244/3.24
3,117,520 * 1/1964 Kerr et al. ..... 244/3.24
3,228,335 * 1/1966 Thompson ..... 244/3.24
3,276,377 * 10/1966 Bell ..... 244/3.24
3,360,216 * 12/1967 Schwesig ..... 244/3.29
3,648,953 * 3/1972 Polk, Jr. ..... 244/3.24
3,650,496 * 3/1972 Svensson ..... 244/3.29
4,693,435 * 9/1987 Percival et al. ..... 244/3.24

FOREIGN PATENT DOCUMENTS 1-1990664 * 8/1965 (DE) ..... 244/3.29

* cited by examiner

*Primary Examiner*—Michael J. Carone
*Assistant Examiner*—Lulit Semunegus
(74) *Attorney, Agent, or Firm*—William J. Benman; Glenn H. Lenzen, Jr.

(57) ABSTRACT

An improved tail fin assembly and method of attachment to a tactical missile capable of high performance motion. The tail fin is formed with a widened inner fin platform portion having a centrally disposed cavity formed by a pair of oppositely disposed walls inclined toward one another. An output control shaft extending from the missile includes a pair of oppositely disposed side walls inclined in a direction similar to the side walls of the cavity. When the tail fin is mounted on the output shaft, the end portion of the output shaft extends within the cavity until the side walls are confronting each other. A pair of fastening screws are advanced into aligned openings, drawing the inclined walls into surface contact to pre-load the tail fin assembly with preset tolerances.

16 Claims, 3 Drawing Sheets

TACTICAL MISSILE CONTROL SURFACE ATTACHMENT

BACKGROUND OF THE INVENTION

1. Field of the Invention

The present invention relates to an improved tail fin assembly and method of attachment as employed in a high performance tactical missile assembly 2. Description of the Related Art High performance tactical missiles employ a plurality of tail fins to control performance of the missile during flight to the target. Known missile assemblies mount each tail fin on a fin platform which is itself attached to the missile by special screws mounted on opposite sides of platform. In order to initiate movement of the tail fins, each platform is attached to a control shaft that mates to the bottom surface of the tail fin assembly. As the control shaft is made to rotate, the attached tail fin also rotates in a pre-determined direction, thereby controlling movement of the tactical missile assembly. A primary drawback to such an attachment assembly is the need for special tools to attach the fin platform to the control shaft. Such tools must be maintained in the inventory of all stations that could possibly have a need to replace a damaged tail fin.

To assure that the tail fin can withstand the forces incurred during high performance flight, known missile assemblies such as the AMRAAM missile employ a tail fin mounted on a fin platform and formed of a complex internal honeycomb/spar design with brazed facesheets: a design that has proven expensive to manufacture. Such a design is also missile specific, preventing the same tail fin construction design from being adapted for a variety of tactical missiles.

It has also been found that maintaining the required tolerances between conventional tail fin assemblies and their missile attachment members can be difficult at best. If the fastening screws attaching the tail fins to the missile are improperly torqued, the tail fin may become misaligned, damaging the aerodynamic integrity of tail fin assembly, which may lead to failure of the missile assembly during flight.

It is clear that there exists a need in the art for an improved tail fin assembly and method of attachment to the missile frame. Such an assembly should be able to be assembled within proper tolerances without the need for any special tools. Preferably, the tail fins should be constructed from a simple, homogenous design which can be manufactured at the lowest possible costs.

SUMMARY OF THE INVENTION

The need in the art is addressed by the unique, controllable fin assembly as well as the unique method of attaching the controllable fin to a control shaft on the missile assembly. The present invention provides a controllable fin, preferably of homogenous design, requiring no special attachment tools and yet capable of being easily assembled within required tolerances.

The controllable fin assembly of the present invention is adaptable for use in a high performance missile capable of unprecedented maneuverability. The fin is of aerodynamic configuration and includes a pair of outer side walls extending between a relatively thin outer edge and a widened inner fin platform. The fin platform has at least one cavity having a mouth and a pair of inclined side walls extending toward one another in a direction away from the mouth. The output control shaft has a pair of inclined side walls extending parallel to the walls of the cavity, such that the side portions make surface contact as the fin cavity is lowered over the output shaft.

The mating surfaces of the fin cavity and control shaft are selectively tightened into firm attachment with each other by fasteners extending through the fin and into control shaft end portion. The inner wall of the fin cavity and the outer walls of the control shaft end portion are inclined relative to the rotational axis of the control shaft. This configuration results in the walls of the cavity being pressed into flat contact with the outer surfaces of the control shaft along the entire surface. In effect, as the tail fin is increasingly forced onto the control shaft by torquing of the fasteners, a high degree of press fit is achieved between the confronting surfaces, while maintaining acceptable static margins of safety against material failure. The tolerances are such that the possible conditions of contact between the fin cavity and output shaft range from flat contact across the entire surface, to predominant contact at the entrance of the cavity in the fin. These tolerances are designed to avoid the condition where contact occurs solely at the deepest part of the fin cavity. This would result in an undesirable instability in the mounting configuration whereby the fin would be allowed to rock back and forth creating an insecure attachment and a danger for material fatigue in the attachment screws. Because the fin is pre-loaded, there is minimum clearance between the fin and the outer surface of the missile, producing a clean aerodynamic profile.

DESCRIPTION OF THE INVENTION

Figure 1:
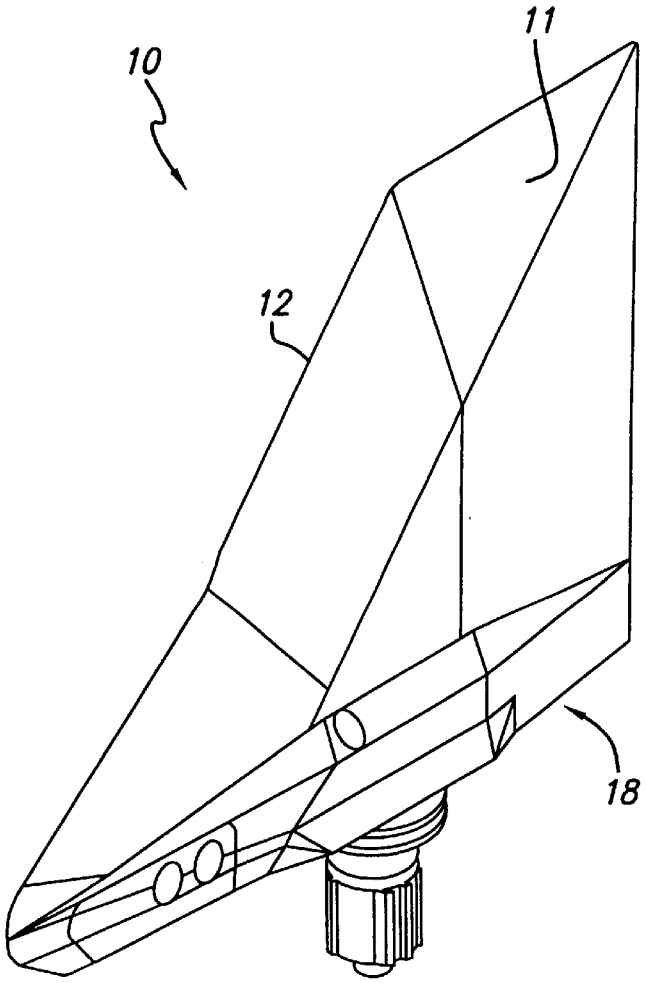
FIG. 1 is a perspective view of a tail fin assembly formed in accordance with the present invention.

Illustrative embodiments and exemplary applications are described below with reference to the accompanying drawings in order to disclose the advantageous teachings of the present invention. As will be explained, the present invention is directed to a fin assembly having a unique design that allows it to be attached to a missile assembly without the need for special tooling. In addition, the mating surfaces of the fin and missile are configured to be press fit together with a pre-loaded pressure that can be readily controlled. As a result, the fin can be formed as a homogenous body rather than requiring honeycombing or the like to protect the fin.

Reference is now made to the accompanying drawings, wherein like reference numerals designate like elements throughout.

FIG. 1 is a perspective view of a tail fin assembly 10 formed in accordance with the present invention. Tail fin assembly 10 consists of pair of outer walls 11 joining each other to form an outer edge 12 having a double-delta shape aerodynamic platform. At its root or base, fin walls 111 are sufficiently faired to provide a desirable aerodynamic presentation and form a hollow fin platform 18.

Figure 2:
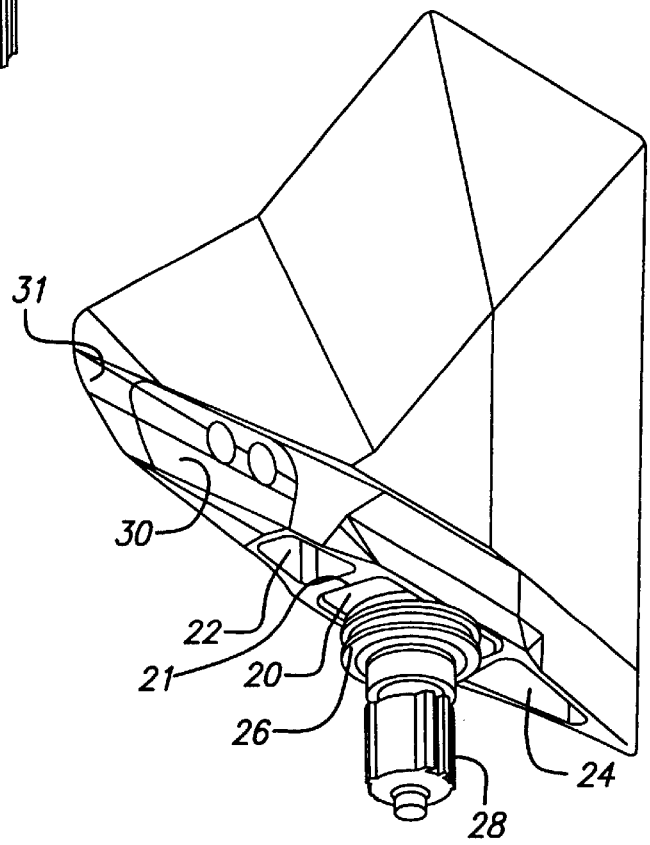
FIG. 2 is a further perspective view of a tail fin assembly formed in accordance with the present invention.

As better shown in FIG. 2, fin platform 18 includes a central cavity 20 having a mouth 21, and additional cavities 22 and 24 disposed fore and an aft central cavity 20. Fore and aft cavities 22 and 24, respectively, are preferably created by machining out portions of fin platform 18. This lightens fin assembly 10 without reducing the stability of tail fin 10. Central cavity 20 is designed to enclose an end portion 26 of an output control shaft 28 driven by a tactical missile's Control Actuation System (CAS), not shown for purposes of clarity. As shown in FIG. 2, a pair of ballast plate inserts 30 are mounted in a web 31 located at the front end portion of fin platform 18. Ballast plates 30 are preferably formed of Tungsten and secured in position by a pair of fasteners which may take the form of screws 32. Each of the screws 32 extends completely though both ballast plates 30 to draw and retain the plates 30 in abutting contact with one another. The ballast plates 30 serve to resist the effect of flutter instability on fin platform 18. The size of ballast plates 30 as well as their position is carefully chosen to control the center of gravity of tail fin assembly 10 as well to favorably affect the structural dynamics of the entire tail fin assembly 10.

Figure 3:
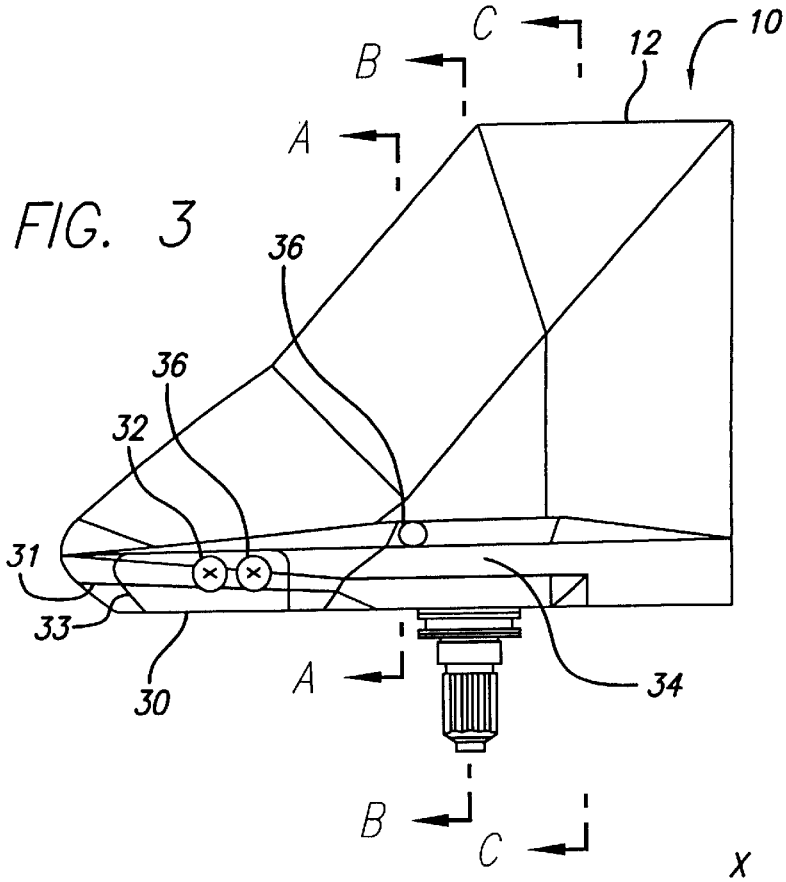
FIG. 3 is a side view of the tail fin assembly of the present invention as shown in FIG. 1.
Figure 4A:
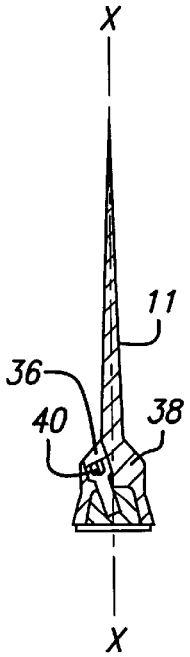
FIGS. 4*a*, 4*b* and 4*c* are cross-section views taken along the sections A—A, B—B and C—C, respectively, of the tail fin assembly of FIG. 3 formed in accordance with the present invention.

Turning to FIG. 3, the hook-shaped contour of web 31 can be clearly seen. The front edge portions 33 of each plate 30 makes surface contact with web 31, preventing ballast plates 30 from inadvertently detaching from tail fin assembly 10. As shown in FIGS. 3 and 1, fin platform 18 includes an outer mold line 34 extending from fore to aft of tail fin 10. Disposed outboard of mold line 34 and fore of output control shaft 28 is fore opening 36. As shown in FIG. 4*a*, opening 36 extends completely through fin platform 18 and is aligned with an opening 38 extending through end portion 26 of output control shaft 38. A fastener 40, may be positioned in the aligned openings 36 and 38 to secure fin platform 18 to the end portion 26 of output control shaft 28. While any conventional fastener 40 may be employed, a screw is preferred. Screw fastener 40 follows a path that is inclined at an angle Ø to the longitudinal axis X—X of output control shaft 28 in order to draw fin platform 18 into tight engagement with end portion 26 of output control shaft 28.

Figure 4B:
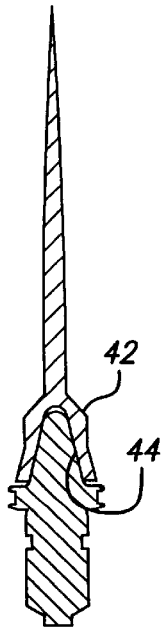

In FIG. 4*b*, tail fin 10 is shown mounted on output control shaft 28. In particular, fin platform 18 is shown as having a pair of inclined walls 42 forming the opposite sides of central cavity 20. The inclination of walls 42 matches the inclination of the side surfaces 44 of the end portion 26 of control shaft 28. As tail fin 10 is drawn into ever tighter contact with control shaft 28, contact extends all along the interface of walls 42 and side surfaces 44 until the fully attached position is reached. At this point, the bottom surface 46 of central cavity 20 contacts the top surface 48 of output control shaft 28.

Figure 4C:
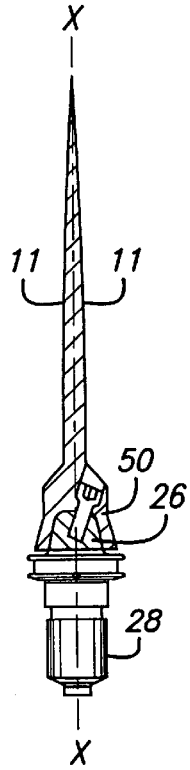

In FIG. 4*c* a second fastener 50 extends through an additional opening 36 in tail platform 18 and an additional aligned opening 38 in the end portion 26 of output control shaft 28. As with fastener 40, fastener 50 preferably takes the form of an attachment screw. Likewise, additional aligned openings 36 and 38 are preferably inclined at an angle Ø to the longitudinal axis X—X of output control shaft 28. As screw fasteners 40 and 50 are rotated to draw fin platform 18 against the end 26 of output control shaft 28, the fact that the interface surfaces 42 and 44 form an angle to the longitudinal axis X—X creates a pre-load that actually aids in the removal of tail fin assembly 10 from output control shaft 28 once the fastening screws 40 and 50 are withdrawn. In effect, the pre-load force will act to force the members apart. While the inclination of the interfaces is sufficient to pre-load tail fin assembly 10, it is not sufficient to create the Morse Taper, or locking effect between the parts.

During performance of the missile system, tail fin assembly 10 is required to resist up to 150% of the maximum predicted aerodynamic load with no structural failure. Static testing on the unique tail fin assembly 10 and its attachment to the output control shaft 28 has been successful a loads over 240% of the predicted loads as well as an additional increase by 30% to account for material degradation at free flight temperatures. The unique configuration of the interface surfaces ensures that the proper tolerances are achieved by the pre-loading engagement while avoiding the possibility of an unstable mounting configuration.

Figure 5:
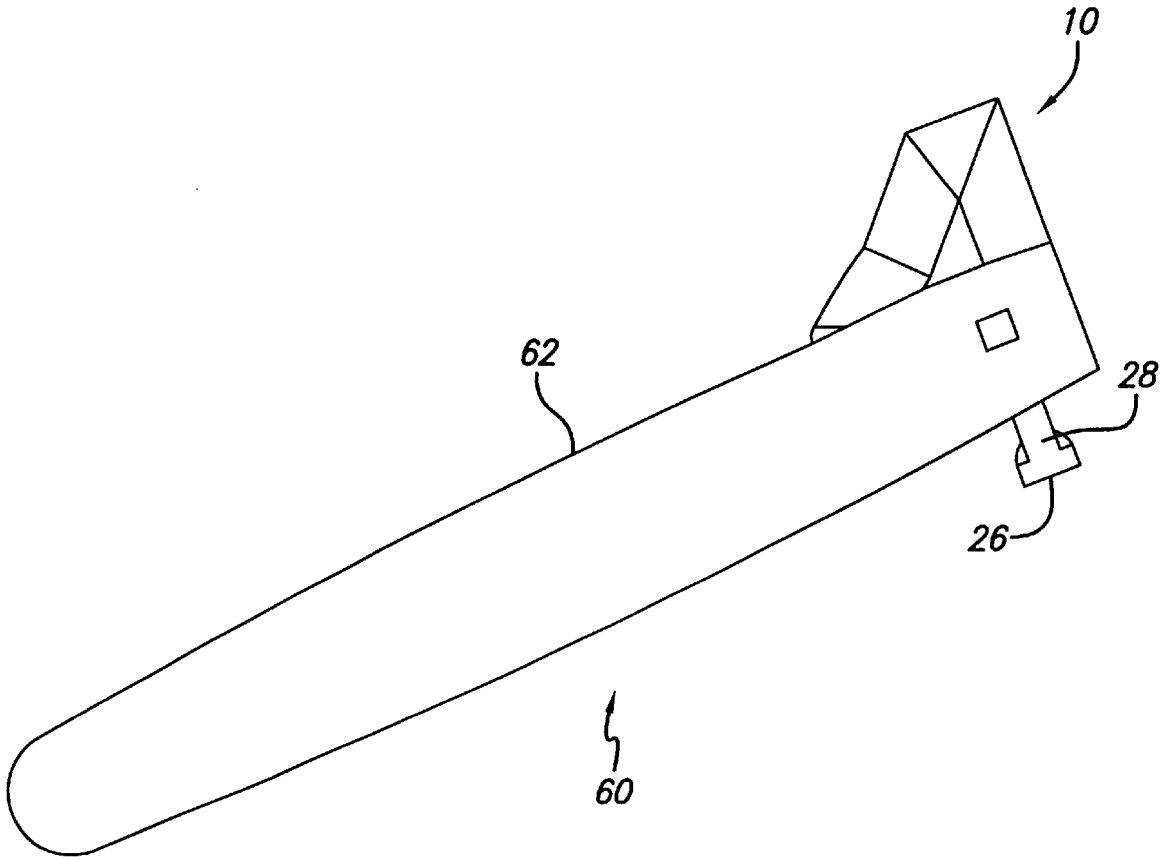
FIG. 5 is a perspective view of an improved tactical missile assembly having a plurality of outputs shafts each supporting a tail fin assembly formed in accordance with the present invention.

An improved tactical missile assembly 60 formed in accordance with the present invention and capable of high performance movement is shown in FIG. 5. Missile 60 includes a plurality of outwardly extending output control shafts 28, with each shaft supporting a tail fin assembly 10 formed in accordance with the present invention. The inclined side surfaces 44 shown on the end portion 26 of output shaft 28. When assembled, each fin assembly 10 positioned such that the end portion 26 extends within a central cavity 20. As the screws 40 and 50 are tightened, the tail fin assembly 10 is drawn into final position adjacent the outer fuselage 62 of missile 60 and the confronting inclined walls 42 and 44 are forced into flat contact along the entire confronting surfaces.

Thus the present invention has been described herein with reference to a particular embodiment for a particular application. Those having ordinary skill in the art and access to the present teachings will recognize additional modifications, applications and embodiments within the scope thereof. Although the invention has been shown as being applicable to the tail fin of a missile assembly, it is in no way limited to this application. Any controllable fin can be formed as in the present invention to allow for attachment to an aerodynamically-shaped fuselage. For example, a small controllable fin assembly formed in accordance with the present invention can be mounted on the forward portion of an aircraft fuselage without the need for special tools and yet be assured that the assembly is secured with acceptable tolerances. A controllable fin may be attached to any land vehicle in accordance with the present invention.

It is therefore intended by the appended claims to cover any and all such applications, modifications and embodiments within the scope of the present invention.

Accordingly,

What is claimed is:

1. An improved, controllable fin assembly for guiding an aerodynamic body during high performance movement, comprising:

a fin of aerodynamic configuration including a pair of outer walls extending between a relatively thin outer edge portion and a widened, inner fin platform portion and an output control shaft extending from the body, and having a pair of oppositely disposed sides inclined toward one another, with the inclined side wall portions of the cavity pre-loaded into abutting surface contact with the inclined sides of the output control shaft when the fin is mounted on the output control for joint rotation as required to control performance of the body, said fin platform portion having:

at least one cavity disposed in a central portion of the platform and formed with a mouth portion facing away from the outer edge and having a pair of oppositely disposed side walls inclined toward one another as the distance from the cavity mouth increases and a curved bottom portion making surface contact with a rounded end portion of the output control shaft when the fin assembly is mounted on the output control shaft.

2. The improved fin assembly of claim 1 wherein the fin platform has a plurality of additional cavities, with at least one cavity positioned on each side of the centrally disposed cavity to reduce the weight of the fin assembly.

3. The improved fin assembly of claim 1 wherein the fin platform includes a web portion and a ballast assembly supported by the web to control the center of gravity of the fin assembly.

4. The improved fin assembly of claim 3 wherein the ballast assembly comprises a pair of ballast plates attached to one another and supported by the web portion.

5. The improved fin assembly of claim 1 wherein at least one fastener extends through an opening formed in the fin platform and an aligned opening in the end portion of the output control shaft, whereby selective advancement of the fastener through the aligned openings causes the inclined side walls of the cavity to be drawn into ever tighter contact with the inclined sides of the output control shaft, until the fin assembly is located adjacent an outer surface of the body.

6. The improved fin assembly of claim 1 wherein a pair of openings are formed in the fin platform on either side of the centrally disposed cavity and corresponding, aligned openings are formed the control shaft end portion, with a separate screw fastener extending through each pair of aligned openings in a direction inclined to the longitudinal axis of the output control shaft.

7. An improved, controllable tail fin assembly for guiding a tactical missile capable of high performance movement, comprising:

a tail fin having a pair of oppositely disposed outer walls extending between a relatively thin outer edge and a widened fin platform portion facing the missile said fin platform portion being of aerodynamic configuration with a central, elongated cavity having a mouth and a pair of oppositely disposed side walls inclined from the mouth toward one another, said fin platform portion further including a web portion formed at a forward end portion thereof, with a ballast assembly supported by the web portion to control the center of gravity of the tail fin assembly, said ballast assembly comprising a pair of Tungsten plates attached to one another and supported by the web portion;

an output control shaft extending from the missile and having a pair of oppositely disposed sides inclined toward one another; and fastening means for drawing the tail fin toward the output control shaft, forcing the confronting side walls of the cavity into ever tighter contact with the inclined surfaces of the output control shaft, whereby selective rotation of the output control shaft causes similar rotation in the attached fin assembly.

8. The improved tail fin assembly of claim 7 wherein the fin platform portion includes an additional pair of cavities, with one cavity positioned on each side of the centrally disposed cavity to reduce the overall weight of the fin assembly.

9. The improved tail fin assembly of claim 7 wherein said fastening means comprises a pair of fastening screws positioned on opposite sides of the centrally disposed cavity from each other, with each screw extending though a pair of aligned openings formed in the fin platform portion and the output control shaft, selectively for drawing the inclined side walls of the cavity into extended surface contact with the inclined surfaces of the output control shaft.

10. The improved tail fin assembly of claim 9 wherein each of the fastening screws in each tail fin assembly is inclined to the longitudinal axis of its respective output control shaft when tail fin assembly on said control shaft.

11. An improved tactical missile assembly capable of high performance movement, comprising:

a missile fuselage having an aerodynamic configuration with a plurality of output control shafts, with each control shaft extending outwardly from and spaced about the circumference of the missile fuselage, and a separate tail fin assembly mounted on each control shaft for joint rotation;

each tail fin assembly having an aerodynamic configuration formed by a pair of oppositely disposed outer walls extending from an outer edge to an inner, widened fin platform portion disposed adjacent the missile fuselage;

each of said fin platform portions including a centrally disposed cavity having a pair of oppositely disposed side walls inclined towards one another; and each of said output control shafts having a pair of oppositely disposed sides inclined towards one another, wherein the confronting inclined side wall portions make surface contact with one another as each tail fin assembly is mounted on its control shaft for joint rotation to control performance of the tactical missile during flight.

12. The improved tactical missile assembly of claim 11 wherein each tail fin assembly is of double-delta configuration.

13. The improved tactical missile assembly of claim 11 wherein a pair of fastening screws are threaded through aligned openings in each fin platform and each output control shaft for drawing each fin assembly into surface contract with its respective output control shaft, whereby the tail fin is pre-loaded on the control shaft within acceptable tolerances.

14. The improved tactical missile assembly of claim 13 wherein each of the fastening screws is inclined relative to the longitudinal axis of its respective output control shaft.

15. A method of forming a tactical missile capable of high performance movement, comprising the steps of:

forming a widened fin platform portion on the inner end of each tail fin;

forming a cavity in the fin platform portion having oppositely disposed side walls inclined toward one another;

forming a output control shaft having a pair of oppositely disposed sides that are inclined towards one another, with the inclined side walls of each fin platform cavity extending substantially parallel to the inclined sides on each output control shaft;

surrounding each output control shaft with a tail fin wherein the inclined sides of each output control shaft confront the inclined side walls of a fin platform cavity;

tightening each tail fin assembly onto its respective output control shaft until the confronting, inclined side walls make surface contact with each other; and tightening a pair of fastening screws extending through the inclined walls of the fin platform and the output control shaft, drawing the inclined walls into contact along their entire interface.

16. The method of forming a tactical missile of claim 15 including the further step of tightening the fastening screws a sufficient amount of pre-load each tail fin assembly on its respective output control shaft within a preset tolerance.

* * * * *